US008740324B2

(12) United States Patent
Kikuchi et al.

(10) Patent No.: US 8,740,324 B2
(45) Date of Patent: Jun. 3, 2014

(54) IMAGE FORMING DEVICE AND IMAGE FORMING METHOD

(71) Applicant: Toshiba Tec Kabushiki Kaisha, Tokyo (JP)

(72) Inventors: Noriyuki Kikuchi, Shizuoka-ken (JP); Jun Takamura, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/762,443

(22) Filed: Feb. 8, 2013

(65) Prior Publication Data

US 2013/0235099 A1 Sep. 12, 2013

(30) Foreign Application Priority Data

Mar. 12, 2012 (JP) ..... 2012-055018

(51) Int. Cl.
*B41J 9/38* (2006.01)
*B41J 2/17* (2006.01)

(52) U.S. Cl.
USPC ..... 347/6; 347/84

(58) Field of Classification Search
USPC ..... 347/5, 6, 14, 84–86
See application file for complete search history.

(56) References Cited

U.S. PATENT DOCUMENTS

| | | | | |
|---|---|---|---|---|
| 6,866,362 | B2 | 3/2005 | Kimura et al. | |
| 7,029,090 | B2 | 4/2006 | Nishida et al. | |
| 7,828,425 | B2 * | 11/2010 | Kang et al. | 347/86 |
| 7,841,706 | B2 * | 11/2010 | Ishinaga et al. | 347/84 |
| 8,047,640 | B2 * | 11/2011 | Uchiyama et al. | 347/85 |
| 8,596,769 | B2 * | 12/2013 | Hibbard et al. | 347/86 |

FOREIGN PATENT DOCUMENTS

| | | |
|---|---|---|
| JP | 2009-208372 | 9/2009 |

* cited by examiner

*Primary Examiner* — Kristal Feggins
(74) *Attorney, Agent, or Firm* — Amin, Turocy & Watson, LLP

(57) ABSTRACT

In a stand-by state, when an instruction unit issues the printing instruction, a control unit is switched in a maintenance state, in the maintenance state, the control unit closes an air valve and operates a first pump, and when a sensor detects that the ink of a second tank is reduced by discharging the ink from a nozzle by the pressure of a second tank, the control unit opens the air valve to be switched in a printing state, and when a predetermined time elapses after an operation of the first pump before the sensor detects the reduction of the ink of the second tank, the control unit excludes the solidified ink from the nozzle, and in the printing state, the control unit is switched in the stand-by state when the ink is discharged from the nozzle of the head based on a printing instruction.

16 Claims, 12 Drawing Sheets

IMAGE FORMING DEVICE AND IMAGE FORMING METHOD

CROSS-REFERENCE TO RELATED APPLICATION

This application is based upon and claims the benefit of priority from the prior Japanese Patent Application No. 2012-055018, filed on Mar. 12, 2012, the entire contents of which are incorporated herein by reference.

FIELD

The present embodiments generally relate to an image forming device and an image forming method.

BACKGROUND

An image forming apparatus such as an inkjet printer discharges ink from a nozzle provided in an inkjet head. When moisture or volatile component is evaporated, a viscosity of the ink is increased and the ink is solidified. When the ink is solidified in the nozzle, a printing error may be caused.

In order to suppress the printing error caused by the solidified ink, for example, it is known that a cap is installed in the inkjet head. The cap covers the nozzle so as to suppress the moisture or the volatile component of the ink from being evaporated. Since increase of the viscosity of the ink is suppressed, the solidification of the ink is also suppressed.

Patent Document 1: Japanese Patent Application Laid-Open No. 2009-208372

DETAILED DESCRIPTION

However, even if the cap is installed in the inkjet head, sometimes the ink is solidified. Therefore, it is required further to improve the method that suppresses the printing error caused by the solidified ink.

In view of the above circumstances, it is provided that an image forming device, comprising: a first tank that accommodates ink; a first path that is connected to the first tank; a second tank that is connected to the first tank through the first path and accommodates the ink; a first pump that is in the first path and transports the ink accommodated in the first tank to the second tank; an air valve that is opened to release the second tank to the atmosphere and is closed to block the second tank from the atmosphere; a second path that is connected to the second tank; a head that is connected to the second tank through the second path, includes a nozzle, and discharges the ink from the nozzle; a maintenance mechanism that excludes solidified ink present in the nozzle from the nozzle; a sensor that is disposed in the second tank and detects the increase or decrease of the ink accommodated in the second tank; an instruction unit that issues a printing instruction; and a control unit that is switched in a stand-by state, a maintenance state, and a printing state, wherein in the stand-by state, when the instruction unit issues the printing instruction, the control unit is switched in the maintenance state, in the maintenance state, the control unit closes the air valve and operates the first pump to transport the ink from the first tank to the second tank to increase a pressure inside the second tank, and when the sensor detects the reduction of the ink of the second tank, the control unit opens the air valve and is switched in the stand-by state, and when a predetermined time elapses after the operation of the first pump before the sensor detects the reduction of the ink of the second tank, the control unit excludes the solidified ink from the nozzle by the maintenance mechanism, and in the printing state, the control unit is switched in the stand-by state when the ink is discharged from the nozzle of the head based on the printing instruction.

According to an aspect of embodiments, an image forming device and an image forming method that suppress the printing error caused by the solidified ink can be provided.

Figure 1:
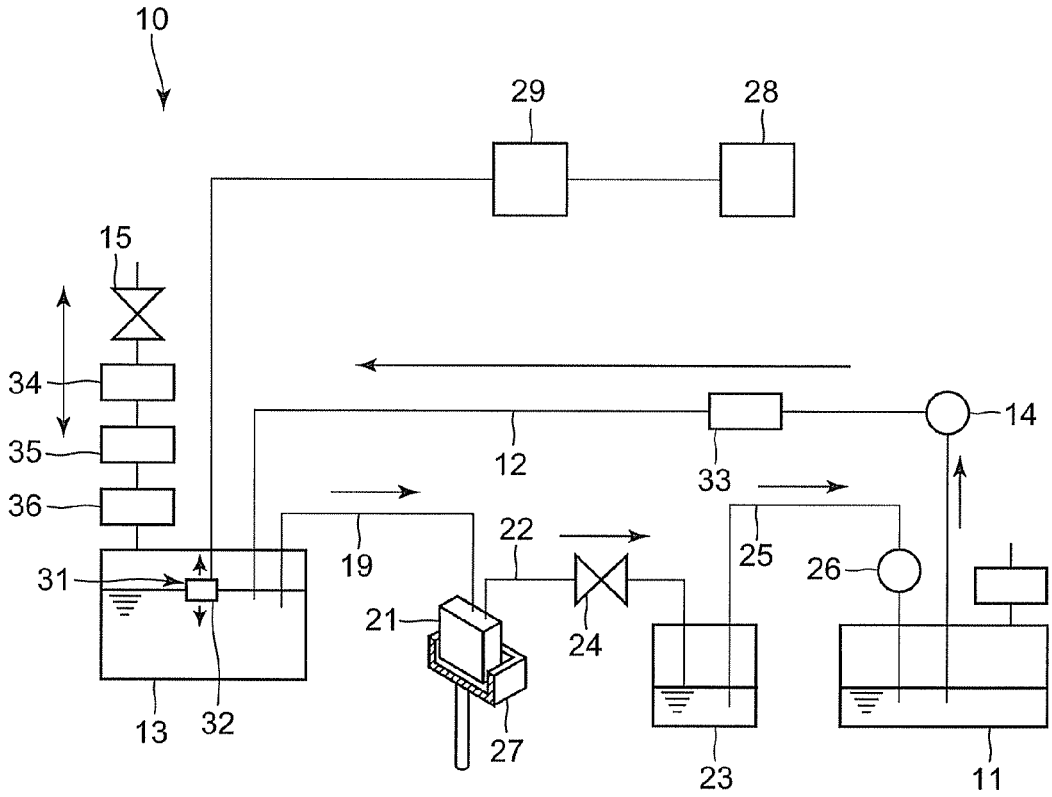
FIG. 1 is a block diagram schematically illustrating an inkjet printer according to a first embodiment.

Hereinafter, a first embodiment will be described with reference to FIGS. 1 to 11. FIG. 1 is a block diagram schematically illustrating an inkjet printer 10. The inkjet printer 10 is an example of an image forming device.

As illustrated in FIG. 1, the inkjet printer 10 includes a first tank 11, a first path 12, a second tank 13, a first pump 14, an air valve 15, a second path 19, a head 21, a third path 22, a third tank 23, a valve 24, a fourth path 25, a second pump 26, a maintenance mechanism 27, an instruction unit 28, and a control unit 29.

The first tank 11 accommodates ink. The first tank 11 can be detached from the inkjet printer 10. When there is no ink which is accommodated in the first tank 11 left, an empty first tank 11 is replaced with a new first tank 11 by a user.

The first path 12 is connected to the first tank 11. The first path 12, for example, is a pipe through which the ink passes. One end of the first path 12 is soaked in the ink accommodated in the first tank 11.

The second tank 13 accommodates ink. The other end of the first path 12 is connected to the second tank 13. The second tank 13 is connected to the first tank 11 through the first path 12.

A sensor 31 is disposed in the second tank 13. The sensor 31 has a float sensor 32. The float sensor 32 floats in the ink accommodated in the second tank 13. The float sensor 32 is turned on when a level of the ink accommodated in the second tank 13 becomes lower than a predetermined height and turned off when the level of the ink becomes higher than the predetermined height. In other words, the float sensor 32 detects the increase and decrease of the ink accommodated in the second tank 13.

The first pump 14 is disposed in the middle of the first path 12. The first pump 14 transports the ink accommodated in the first tank 11 to the second tank 13. The first pump 14 is operated or stopped by the control unit 29.

In the middle of the first path 12, an ink filter 33 is disposed. The ink filter 33 purifies the ink transported from the first tank 11 to the second tank 13 through the first path 12.

An air valve 15 is connected to the second tank 13. When the air valve 15 is opened, the second tank 13 is released to the atmosphere. When the air valve 15 is closed, the second tank 13 is blocked from the atmosphere. The air valve 15 is opened/closed by the control unit 29.

An overflow catcher 34, an air filter 35, and an overflow sensor 36 are interposed between the air valve 15 and the second tank 13. The overflow catcher 34 blocks overflowing ink. The air filter 35 purifies air which enters the second tank 13 through the air valve 15. The overflow sensor 36 detects overflowing ink.

The second path 19 is connected to the second tank 13. The second path 19, for example, is a pipe through which the ink passes. One end of the second path 19 is soaked in the ink accommodated in the second tank 13.

The third path 22 is connected to the head 21. The third path 22, for example, is a pipe through which the ink passes.

The third tank 23 accommodates ink. The third path 22 is connected to the third tank 23. The third tank 23 is connected to the head 21 through the third path 22.

Figure 2:
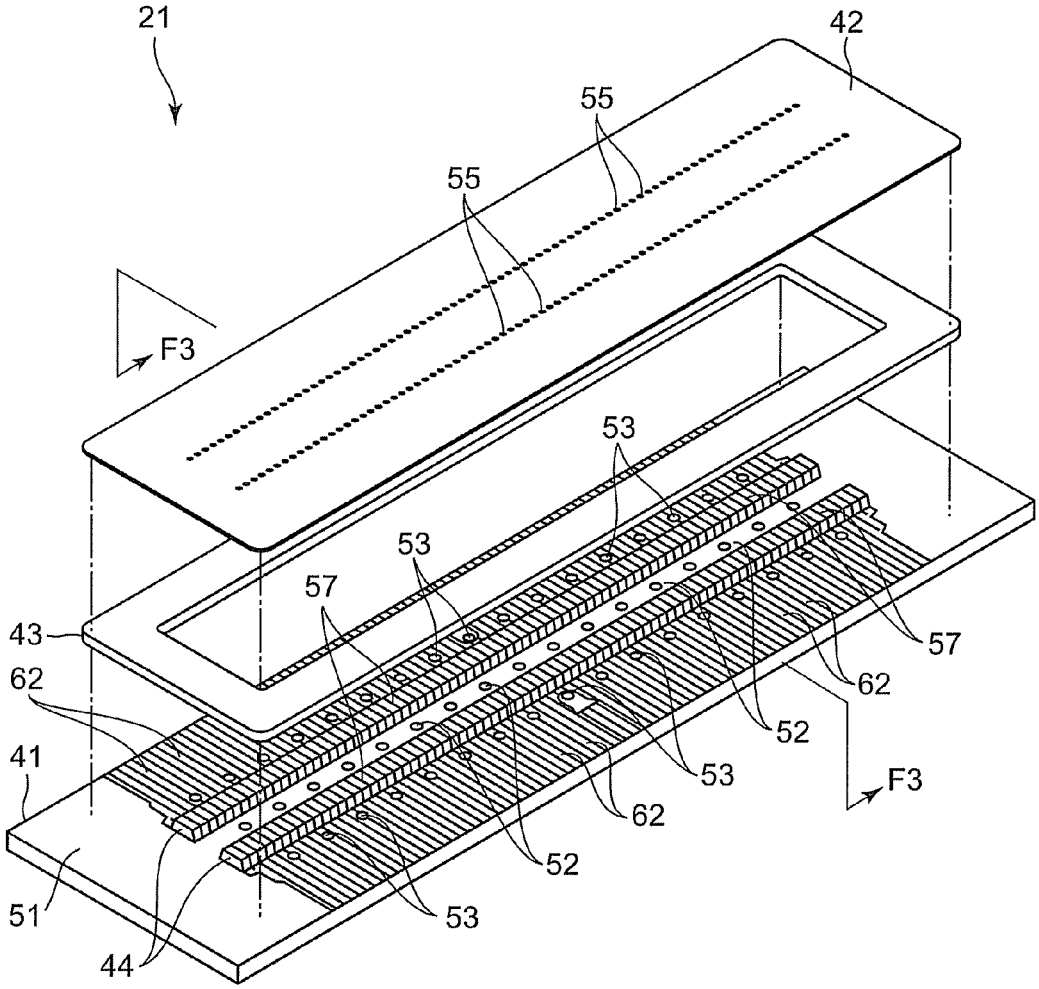
FIG. 2 is a perspective view illustrating an exploded state of a part of a head according to the first embodiment.
Figure 3:
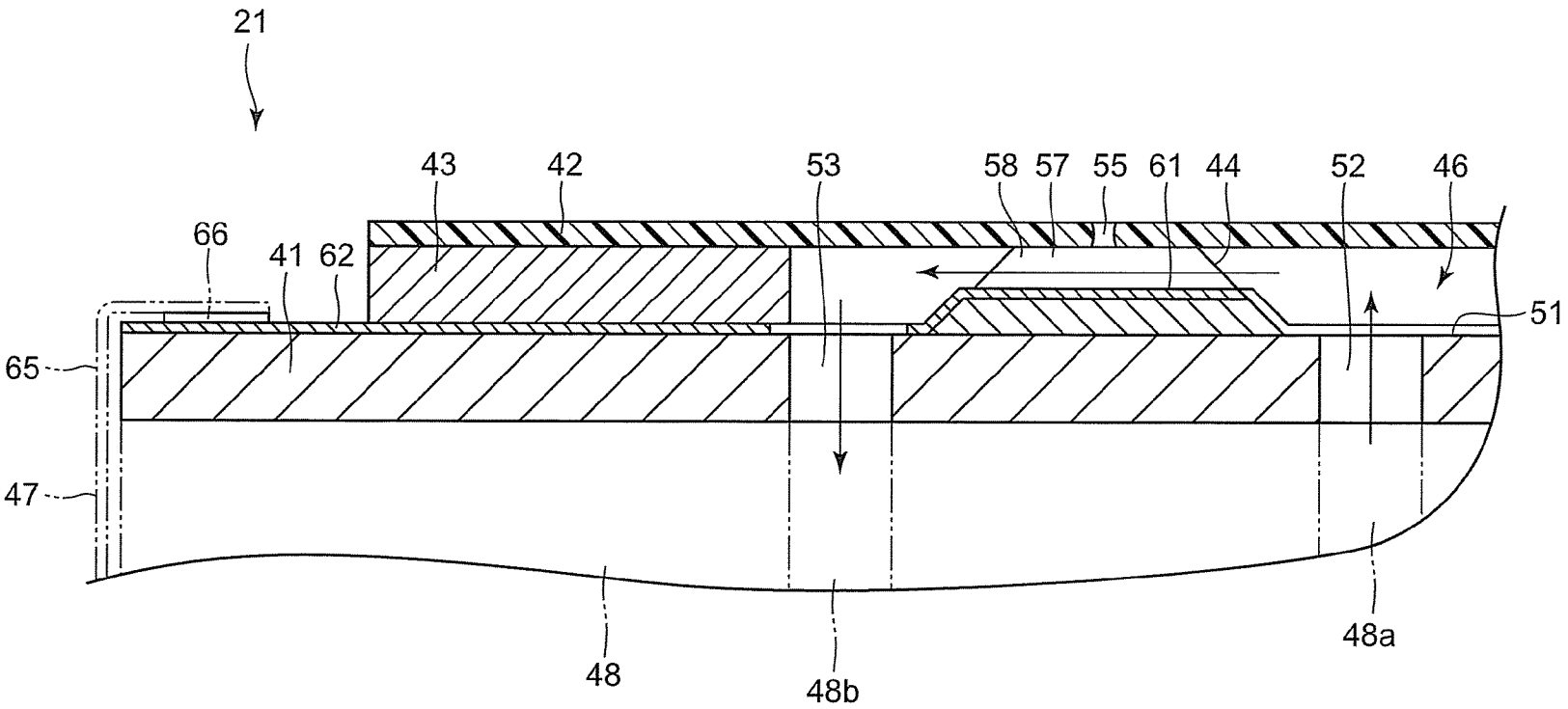
FIG. 3 is a cross-sectional view illustrating a part of the head according to the first embodiment taken along the line F3-F3 of FIG. 2.

FIG. 2 is a perspective view illustrating an exploded state of a part of the head 21. FIG. 3 is a cross-sectional view illustrating a part of the head 21 taken along the line F3-F3 of FIG. 2. As illustrated in FIG. 2, the head 21 is a so-called side-shooter type share mode share wall method inkjet head. The head 21 is a device that discharges the ink and is mounted inside the inkjet printer 10.

The head 21 includes a base plate 41, a nozzle plate 42, a frame member 43, and a pair of driving elements 44. As illustrated in FIG. 3, an ink chamber 46 to which the ink is supplied is formed inside the head 21.

Further, as illustrated with two-dot chain line in FIG. 3, various components such as a circuit board 47 that controls the head 21 or a manifold 48 that forms a part of the path between the head 21 and the second tank 13 are installed in the head 21.

As illustrated in FIG. 2, the base plate 41, for example, is formed to have a rectangle board shape by ceramics such as alumina. The base plate 41 has a flat mounting surface 51. In the mounting surface 51, a plurality of supplying holes 52 and a plurality of discharging holes 53 are provided.

The supplying holes 52 are provided in juxtaposition at the center of the base plate 41 along the longitudinal direction of the base plate 41. As illustrated in FIG. 3, the supplying holes 52 communicate with an ink supply unit 48*a* of the manifold 48 connected to the second path 19.

The supplying holes 52 are connected to the second path 19 through the ink supply unit 48*a*. The head 21 is connected to the second tank 13 through the second path 19. As illustrated with an arrow in FIG. 3, the ink of the second tank 13 is supplied from the supplying hole 52 to the ink chamber 46 through the second path 19 and the ink supply unit 48*a* of the manifold 48.

As illustrated in FIG. 2, the discharging holes 53 are provided in two rows parallel to each other to have the supplying hole 52 interposed between the discharging holes 53. As illustrated in FIG. 3, the discharging hole 53 communicates with an ink discharging unit 48*b* of the manifold 48 connected to the third path 22.

The discharging hole 53 is connected to the third path 22 through the ink discharging unit 48*b*. As illustrated with an arrow in FIG. 3, the ink of the ink chamber 46 is discharged from the discharging holes 53 to the third tank 23 through the ink discharging unit 48*b* of the manifold 48 and the third path 22.

As illustrated in FIG. 2, the nozzle plate 42 is formed by a rectangular film formed of polyimide, for example. The nozzle plate 42 may be formed of other materials such as stainless. The nozzle plate 42 faces the mounting surface 51 of the base plate 41.

A plurality of nozzles 55 is provided in the nozzle plate 42. The plurality of nozzles 55 is disposed in two rows along the longitudinal direction of the nozzle plate 42. The nozzle 55 faces a portion between the supplying holes 52 and the discharging holes 53 of the mounting surface 51.

The frame member 43 is formed to have a rectangular frame shape, for example, by nickel alloy. The frame member 43 is interposed between the mounting surface 51 of the base plate 41 and the nozzle plate 42. The frame member 43 is attached to the mounting surface 51 and the nozzle plate 42, respectively. In other words, the nozzle plate 42 is installed in the base plate 41 through the frame member 43.

As illustrated in FIG. 3, the ink chamber 46 is enclosed by the base plate 41, the nozzle plate 42, and the frame member 43. The ink chamber 46 is formed between the base plate 41 and the nozzle plate 42.

The pair of driving elements 44 is formed by two plate shaped piezoelectric elements formed of lead zirconate titanate (PZT), for example. The two piezoelectric elements are adhered such that the directions of polarization are inversed to each other in the thickness direction.

The pair of driving elements 44 is attached to the mounting surface 51 of the base plate 41. The driving elements 44 are attached to the mounting surface 51 by a thermosetting epoxy based adhesive, for example. As illustrated in FIG. 2, the driving elements 44 are disposed in the ink chamber 46 to be parallel to each other corresponding to the nozzles 55 arranged in parallel in two rows. The driving element 44 is formed in a sectional trapezoidal shape. An apex of the driving element 44 is attached to the nozzle plate 42.

As illustrated in FIG. 3, a plurality of pressure chambers 57 is provided in the driving element 44. The pressure chambers 57 are grooves formed in the driving element 44. The driving element 44 has a plurality of side walls 58 that forms the pressure chambers 57. The pressure chambers 57 extend in a direction intersecting the longitudinal direction of the driving element 44 to be in juxtaposition along the longitudinal direction of the driving element 44.

A plurality of nozzles 55 of the nozzle plate 42 is formed in the plurality of pressure chambers 57. As illustrated in FIG. 3, the pressure chambers 57 are open toward the ink chamber 46. Therefore, as illustrated with an arrow in FIG. 3, the ink passes through the pressure chamber 57 of the driving element 44.

Electrodes 61 are provided in the pressure chambers 57, respectively. The electrodes 61, for example, are formed by a nickel thin film. The electrodes 61 cover inner surfaces of the pressure chambers 57.

As illustrated in FIG. 2, a plurality of wiring patterns 62 is provided from the mounting surface 51 of the base plate 41 to the driving element 44. The wiring patterns 62, for example, are formed by a nickel thin film. The wiring patterns 62 extend from the electrodes 61 formed in the pressure chambers 57 of the driving element 44 to one side edge of the mounting surface 51.

As illustrated in FIG. 3, the circuit board 47 is a film carrier package (FCP) and includes a flexible resin film 65 on which a plurality of wiring lines is formed and ICs connected to the plurality of wiring lines of the film 65. The FCP may also be referred to as a tape carrier package (TCP).

The film 65 is a tape automated bonding (TAB). The ICs are components that apply a voltage to the electrode 61. The ICs are fixed to the film 65 by a resin, for example.

An edge of the film 65 is thermally clamping-connected to the wiring patterns 62 by an anisotropic conductive film (ACF) 66. Therefore, the plurality of wiring lines of the film 65 is electrically connected to the wiring pattern 62. By connecting the film 65 to the wiring patterns 62, the ICs are electrically connected to the electrode 61 through the wiring lines of the film 65.

As illustrated in FIG. 1, the valve 24 is disposed in the middle of the third path 22. When the valve 24 is closed, the third path 22 is blocked. When the valve 24 is open, the third path 22 is open. The valve 24 is opened/closed by the control unit 29.

The fourth path 25 connects the third tank 23 and the first tank 11. The fourth path 25, for example, is a pipe through which the ink passes. One end of the fourth path 25 is soaked in the ink accommodated in the third tank 23.

The second pump 26 is disposed in the middle of the fourth path 25. The second pump 26 transports the ink accommodated in the third tank 23 to the first tank 11. The second pump 26 is operated or stopped by the control unit 29.

Figure 4:
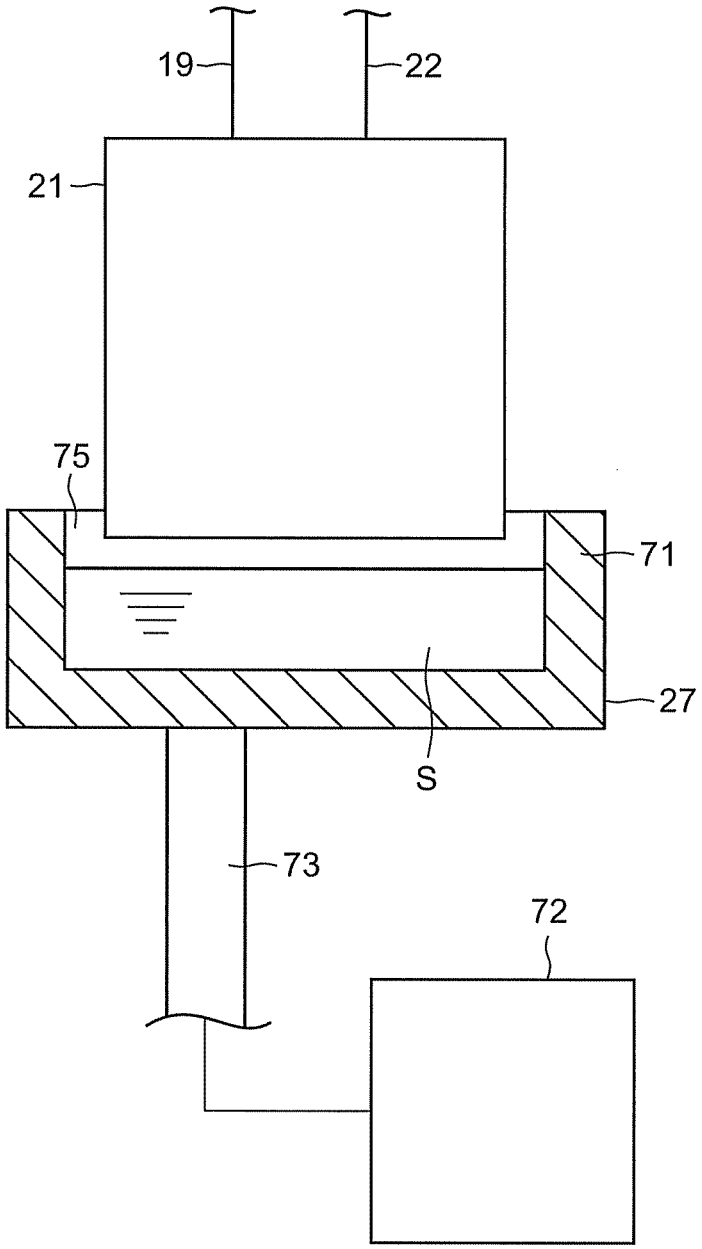
FIG. 4 is a cross-sectional view illustrating a head and a maintenance mechanism according to the first embodiment.

FIG. 4 is a cross-sectional view illustrating the head 21 and the maintenance mechanism 27. The maintenance mechanism 27 includes a tank 71 and a solvent supplying device 72, and a pipe 73. The tank 71 is formed in a box shape. An opening 75 is provided at an upper part of the tank 71. The head 21 moves in and out the tank 71 through the opening 75.

A solvent S is accommodated in the tank 71. The solvent S is the same solvent as a solvent contained in the ink accommodated in the first to third tanks 11, 13, and 23. However, the solvent S is not limited thereto, but may be another solvent that lowers the viscosity of the ink accommodated in the first to third tanks 11, 13, and 23. Instead of the solvent S, other liquid such as the ink same as the ink accommodated in the first to third tanks 11, 13, and 23 may be accommodated in the tank 71.

The solvent supplying device 72 is connected to the tank 71 through the pipe 73. The solvent supplying device 72 accommodates the solvent S. The solvent supplying device 72 supplies the solvent S to the tank 71, for example, by a pump.

The instruction unit 28 and the control unit 29 illustrated in FIG. 1 function by various electronic components such as an integrated circuit or a memory. The instruction unit 28 and the control unit 29 may be individual devices or a single device.

The instruction unit 28, for example, issues a printing instruction by manipulation of the user. The printing instruction, for example, is information which is used to print an image based on the manipulation of the user.

The control unit 29 is connected to the instruction unit 28 and receives the printing instruction issued by the instruction unit 28. The control unit 29 is connected only to the float sensor 32 in FIG. 1. However, the control unit 29 may be connected to various elements. The control unit 29 controls the first pump 14, the air valve 15, the head 21, the valve 24, the second pump 26, and the maintenance mechanism 27.

The inkjet printer 10 and the control unit 29 are switched in a stand-by state, a maintenance state, and a printing state. As illustrated in FIG. 1, in the stand-by state, the control unit 29 opens the valve 24 and operates the second pump 26. When the second pump 26 is operated, the ink accommodated in the third tank 23 is transported to the first tank 11. When a pressure inside the third tank 23 is lowered as the ink is transported, the ink accommodated in the second tank 13 is transported to the third tank 23 through the head 21. The ink passes through the pressure chambers 57 of the driving element 44 in the head 21.

When the ink is transported, the level of the ink accommodated in the second tank 13 is lowered. When the level of the ink of the second tank 13 becomes lower than a predetermined height, the float sensor 32 is turned on. When the float sensor 32 is turned on, the control unit 29 operates the first pump 14. In other words, when the sensor 31 detects that an amount of reduced ink of the second tank 13 is more than the predetermined amount, the control unit 29 operates the first pump 14. By operating the first pump 14, the ink accommodated in the first tank 11 is transported to the second tank 13. When the level of the ink of the second tank 13 reaches a predetermined height by transporting the ink, the float sensor 32 is turned off. When the float sensor 32 is turned off, the control unit 29 stops the first pump 14. Accordingly, in the inkjet printer 10, the ink is circulated.

As illustrated in FIG. 4, the control unit 29 inserts the head 21 in the tank 71 of the maintenance mechanism 27. The head 21 is disposed in a position spaced apart from the solvent S. Further, the head 21 may be soaked in the solvent S.

Figure 5:
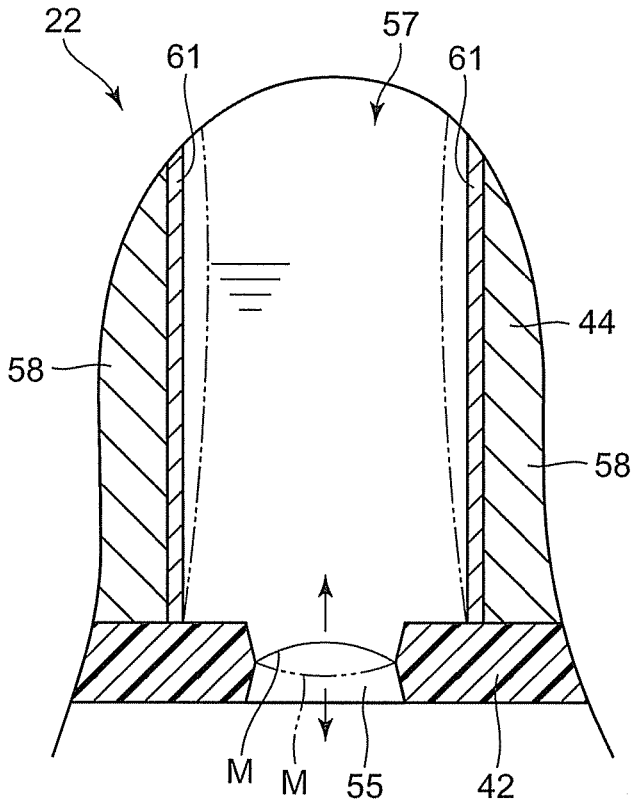
FIG. 5 is a cross-sectional view illustrating a part of the head according to the first embodiment.

FIG. 5 is a cross-sectional view illustrating a part of the head 21. As illustrated in FIG. 5, a meniscus M which is a surface of the ink is formed in the nozzle 55. The circuit board 47 of the head 21 which is controlled by the control unit 29 intermittently applies a voltage to the electrode 61. When the voltage is applied to the electrode 61, the side wall 58 of the driving element 44 is modified in a share mode and the ink of the pressure chamber 57 is pressurized or depressurized. By pressurizing or depressurizing the ink, as illustrated with a two-dot chain line in FIG. 5, the meniscus M is fluctuated.

Figure 6:
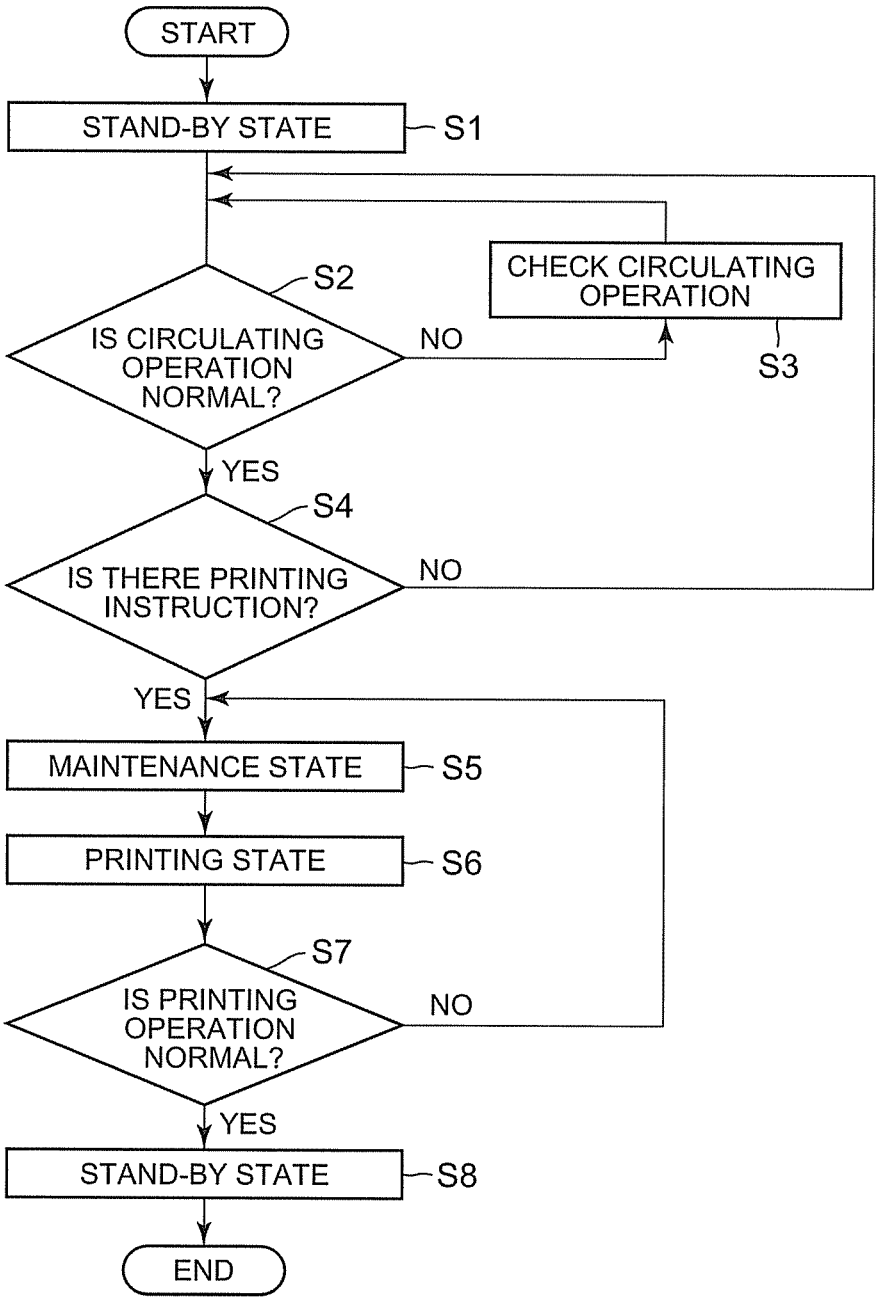
FIG. 6 is a flowchart illustrating an example of an image forming method of an inkjet printer according to the first embodiment.
Figure 7:
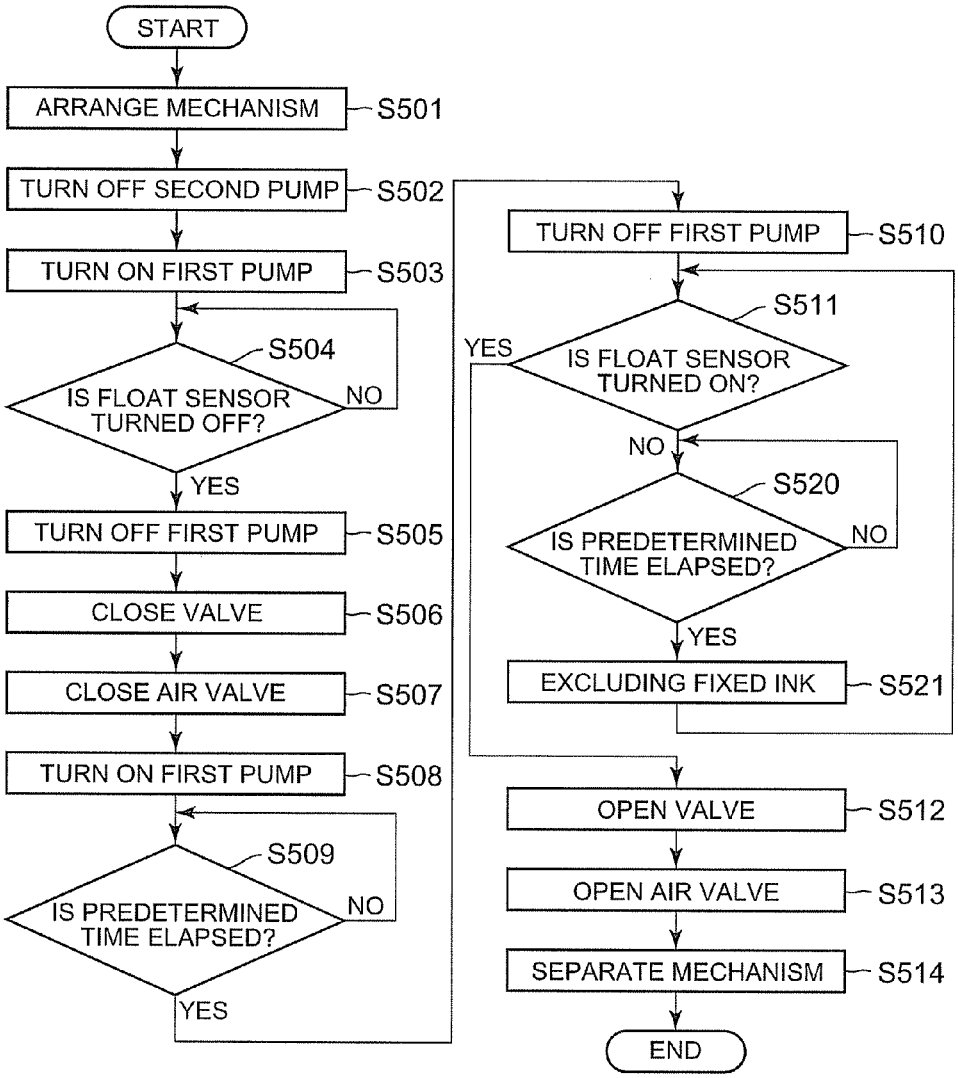
FIG. 7 is a flowchart illustrating an example of a maintenance state of the inkjet printer according to the first embodiment.

Hereinafter, an example of an image forming method of the inkjet printer 10 will be described with reference to FIGS. 6 to 10. FIG. 6 is a flowchart illustrating an example of the image forming method of the inkjet printer 10. FIG. 7 is a flowchart illustrating an example of a maintenance state of the inkjet printer 10.

As illustrated in FIG. 6, the inkjet printer 10 and the control unit 29 are in a stand-by state (S1). The operations of the inkjet printer 10 and the control unit 29 in the stand-by state S1 are the same as described above. Therefore, the description thereof will be omitted.

During the stand-by state S1, the control unit 29 monitors whether a circulating operation of the ink is normal using various sensors (S2). When the circulating operation of the ink is not normal, the control unit 29 checks an abnormal portion in the circulating operation of the ink (S3), and for example, displays a message to notify the abnormality to the user.

The control unit 29 waits the printing instruction from the instruction unit 28 (S4) in the stand-by state (S1). For example, when the instruction unit 28 issues the printing instruction by the manipulation of the user, the inkjet printer 10 and the control unit 29 are switched in a maintenance state (S5).

Figure 8:
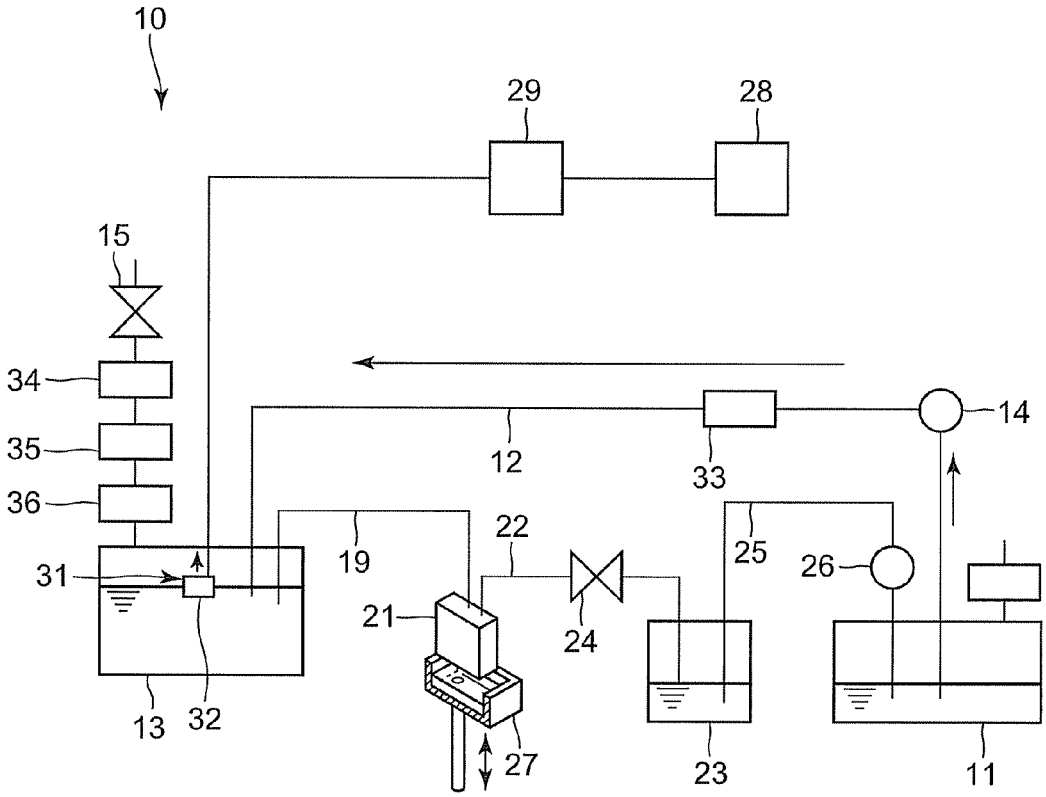
FIG. 8 is a block diagram schematically illustrating an inkjet printer in a maintenance state according to the first embodiment.

FIG. 8 is a block diagram schematically illustrating the inkjet printer 10 in a maintenance state. As illustrated in FIG. 7, when the control unit 29 moves in the maintenance state (S5), the control unit 29 disposes the maintenance mechanism 27 in a predetermined position (S501). For example, the control unit 29 separates the tank 71 of the maintenance mechanism 27 slightly from the head 21. The tank 71 of the maintenance mechanism 27 faces the nozzle 55 of the head 21 in a predetermined position.

Next, the control unit 29 stops the second pump 26 (S502) and operates the first pump 14 (S503). By the first pump 14, the ink accommodated in the first tank 11 is transported to the second tank 13. When the level of the ink accommodated in the second tank 13 is increased to a predetermined height, the float sensor 32 is turned off. When the float sensor 32 is turned off (S504), the control unit 29 stops the first pump 14 (S505).

Next, the control unit 29 closes the valve 24 and blocks the third path 22 (S506). The control unit 29 closes the air valve 15 to block the second tank 13 from the atmosphere (S507).

Next, the control unit 29 operates the first pump 14 (S508). When the ink is transported from the first tank 11 to the second tank 13 by the first pump 14, the pressure inside the second tank 13 is increased since the air valve 15 is closed. When a predetermined time elapses after the first pump 14 is operated (S509), the control unit 29 stops the first pump 14 (S510).

By the increased pressure inside the second tank 13, the ink accommodated in the second tank 13 is discharged from the nozzle 55 of the head 21. The ink discharged from the nozzle 55 is received in the tank 71 of the maintenance mechanism 27.

By discharging the ink from the head 21, the level of the ink accommodated in the second tank 13 is lowered. When the level of the ink of the second tank 13 is lowered to be lower than a predetermined height, the float sensor is turned on (S511). In other words, the sensor 31 detects that the ink of the second tank 13 is reduced.

When the float sensor 32 is turned on, the control unit 29 opens the valve 24 (S512). The control unit 29 opens the air valve 15 to release the second tank 13 to the atmosphere (S513).

Next, the control unit 29 separates the maintenance mechanism 27 from the head 21 (S514). The maintenance mechanism 27 retreats from a position which faces the nozzle 55 of the head 21. Accordingly, the maintenance state (S5) is completed and the inkjet printer 10 and the control unit 29 are switched in a printing state (S6) as illustrated in FIG. 6.

As illustrated in FIG. 7, in the maintenance state (S5), after the first pump 14 is stopped (S510), a predetermined time may elapse (S520) while the float sensor is turned off (S511). For example, when the ink is solidified in the nozzle 55, the discharging of the ink from the nozzle 55 is interrupted, and the level of the ink of the second tank 13 does not change. In this case, the control unit 29 performs a solidified ink removing operation (S521).

Figure 9:
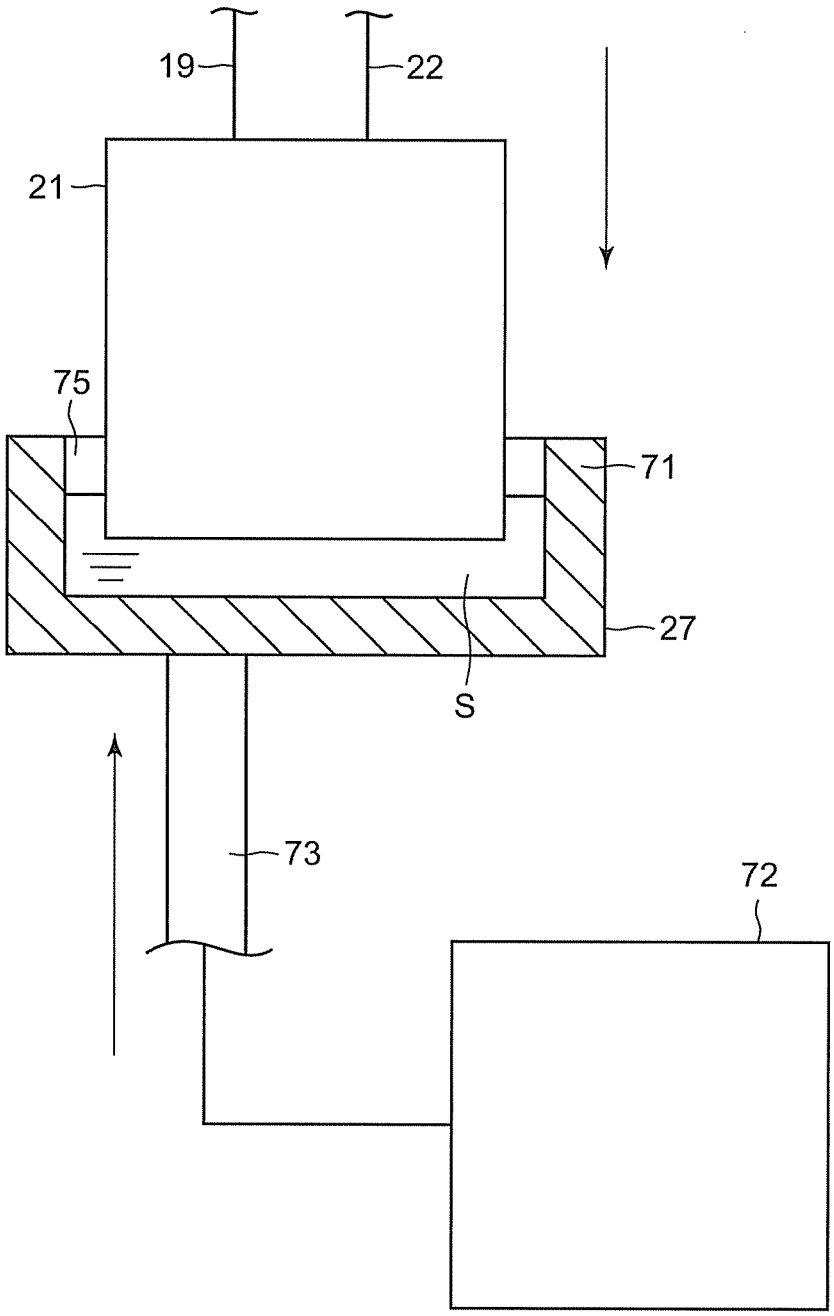
FIG. 9 is a cross-sectional view illustrating a head and a maintenance mechanism in a solidified ink removing operation according to the first embodiment.

FIG. 9 is a cross-sectional view illustrating the head 21 and the maintenance mechanism 27 in a solidified ink removing operation (S521). In the solidified ink removing operation (S521), the tank 71 of the maintenance mechanism 27 is fitted in the head 21.

The nozzle 55 of the head 21 is soaked in the solvent S accommodated in the tank 71. The solvent S lowers the viscosity of the solidified ink in the nozzle 55. For example, the solvent S moisturizes the dried and solidified ink and agitates the ink which is solidified by the deposited pigment.

When a predetermined time elapses after soaking the head 21 in the solvent S, the control unit 29 separates the head 21 from the tank 71. In other words, the head 21 is pulled up from the solvent S. The maintenance mechanism 27 discharges the solvent S received in the tank 71 through the pipe 73. The maintenance mechanism 27 supplies a new solvent S from the solvent supplying device 72 to the tank 71. Accordingly, the solidified ink removing operation (S521) is completed.

The solidified ink whose viscosity is lowered is extruded by the ink of the head 21 and then removed from the nozzle 55. By removing the solidified ink, ink is discharged from the nozzle 55 and the level of the ink accommodated in the second tank 13 is lowered. When the level of the ink accommodated in the second tank 13 is lowered, the float sensor 32 is turned on (S511).

In other words, before the sensor 31 detects the reduction of the ink of the second tank 13, when a predetermined time elapses (S520) after the first pump 14 is operated (S508), the solidified ink is excluded from the nozzle 55 by the maintenance mechanism 27 (S521).

After the solidified ink removing operation (5521), a predetermined time may elapse (S520) while the float sensor 32 is turned off (S511). In this case, the solidified ink removing operation is performed again (S521). In other words, after removing the solidified ink from the nozzle 55 by the maintenance mechanism 27, when a predetermined time elapses after the operation of the maintenance mechanism 27 before the sensor 31 detects the reduction of the ink of the second tank 13, the control unit 29 further excludes the solidified ink from the nozzle 55 by the maintenance mechanism 27.

Figure 10:
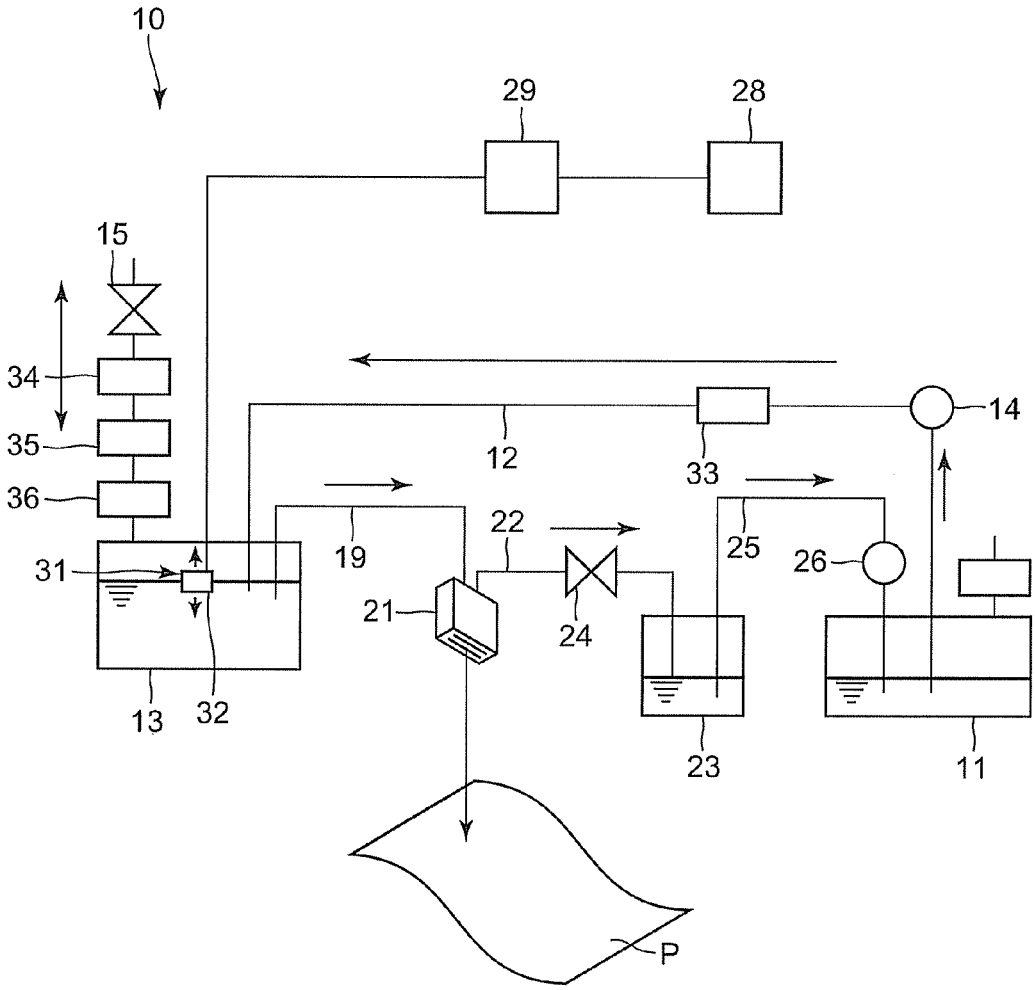
FIG. 10 is a block diagram schematically illustrating an inkjet printer in a printing state according to the first embodiment.

FIG. 10 is a block diagram schematically illustrating the inkjet printer 10 in a printing state. As illustrated in FIG. 10, in the printing state (S6), a printing medium P is disposed below the head 21. The printing medium P is, for example, a paper, a fabric, or a resin product.

The head 21 modifies the driving element 44 in a share mode based on the printing instruction issued by the instruction unit 28. The ink in the pressure chamber 57 is depressurized or pressurized by the driving element 44 modified in a share mode and discharged from the nozzle 55.

The discharged ink is attached on the printing medium P. After discharging the ink, the head 21 and the printing medium P move. The head 21 repeatedly discharges the ink based on the printing instruction to form an image on the printing medium P.

As illustrated in FIG. 6, during the printing status (S6), the control unit 29, for example, monitors whether the printing operation is normal using various sensors (S7). When the printing operation is not normal, the control unit 29 is switched in the maintenance state (S5) again.

When the image is formed on the printing medium P based on the printing instruction, the printing state (S6) is completed. When the printing state (S6) is completed, the inkjet printer 10 and the control unit 29 are switched in the stand-by state (58). As described above, the inkjet printer 10 forms an image.

Figure 11:
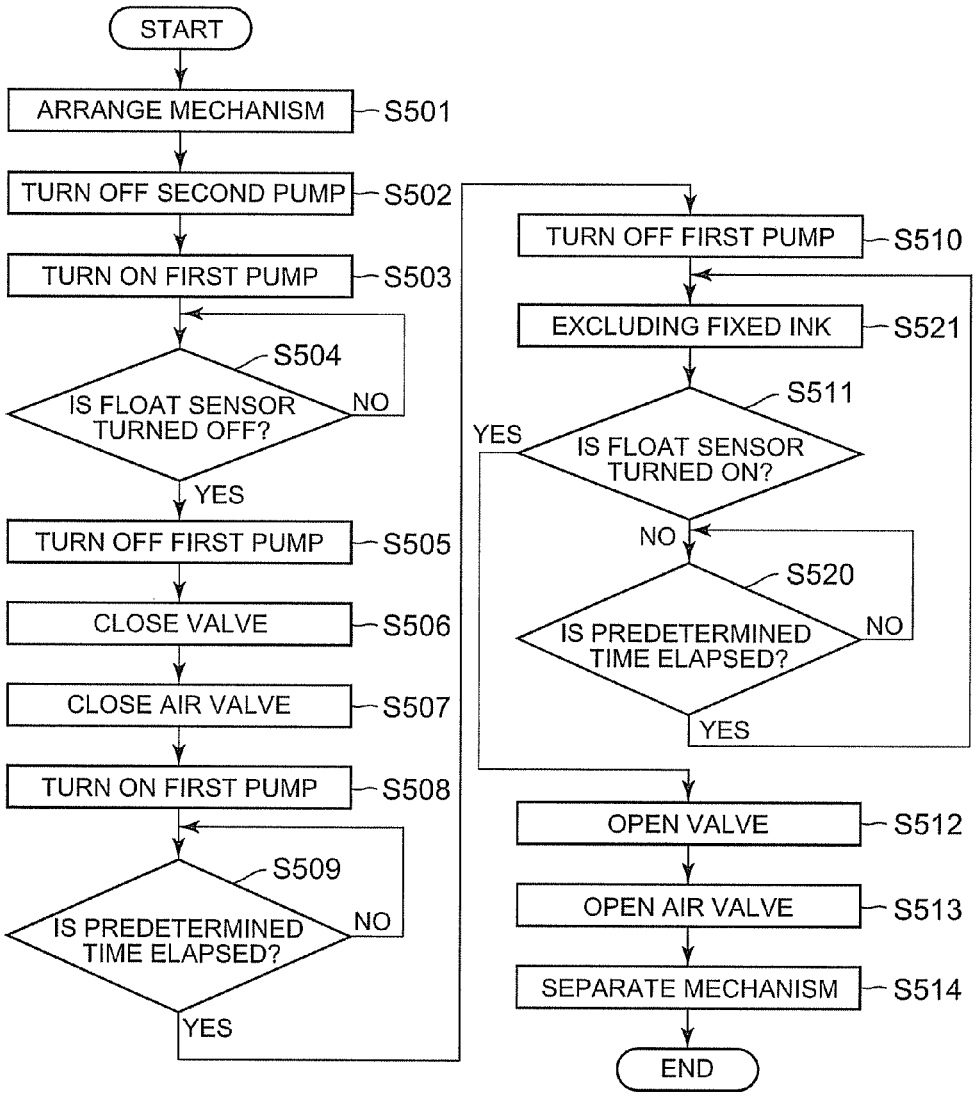
FIG. 11 is a flowchart illustrating another example of a maintenance state of the inkjet printer according to the first embodiment.

The image forming method of the inkjet printer 10 is not limited to the above description. FIG. 11 is a flowchart illustrating another example of a maintenance state of the inkjet printer 10. In the example illustrated in FIG. 11, in the maintenance state (S5), the solidified ink removing operation (S521) is performed after the first pump 14 is stopped (S510). After the solidified ink removing operation (S521), when the float sensor 32 is turned on (S511), the valve 24 is opened by the control unit 29 (S512). When a predetermined time elapses before the float sensor 32 is turned on (S520), the solidified ink removing operation (521) is performed again.

Further, for example, in the stand-by state (S1 and S8), the maintenance mechanism 27 may be disposed so as to be spaced apart from the head 21. When the maintenance mechanism 27 is separated from the head, the solvent S of the maintenance mechanism 27 is suppressed from influencing the nozzle plate 42. In this case, in the maintenance state S5, the maintenance mechanism 27 moves from a position which is apart from the head 21 to a position which faces the nozzle 55 of the head 21 (S501).

In the stand-by states (S1 and S8), the tank 71 may be empty without accommodating the solvent S. In this case, the control unit 29 allows the solvent supplying device 72 to supply the solvent S to the tank 71 in the maintenance state (S5). When the maintenance state (S5) is completed, the control unit 29 discharges the solvent S from the tank 71 through the pipe 73.

According to the inkjet printer 10 with the above configuration, the control unit 29 closes the air valve 15 in the maintenance state (S5) and operates the first pump to transport the ink from the first tank 11 to the second tank 13 so as to increase the pressure inside the second tank 13. The ink is discharged from the nozzle 55 of the head 21 by the pressure of the second tank 13 so that the ink of the second tank 13 is reduced. When the sensor 31 detects the reduction of the ink, the control unit 29 opens the air valve 15 to be switched in the printing state (S6). Before the sensor 31 detects the reduction of the ink of the second tank 13, when a predetermined time elapses after the operation of the first pump 14, the control unit 29 excludes the solidified ink from the nozzle 55 by the maintenance mechanism 27. Accordingly, the printing error due to the solidified ink is suppressed.

According to another example of the image forming method of the inkjet printer 10, in the maintenance state (S5), the control unit 29 closes the air valve 15 and excludes the solidified ink from the nozzle 55 by the maintenance mechanism 27. The control unit 29 operates the first pump 14 to transport the ink from the first tank 11 to the second tank 13 to increase the pressure inside the second tank 13. The ink is discharged from the nozzle 55 of the head 21 by the pressure of the second tank 13 so that the ink of the second tank 13 is reduced. When the sensor 31 detects the reduction of the ink, the control unit 29 opens the air valve 15 to be switched in the printing state (S6). Accordingly, the printing error due to the solidified ink is suppressed.

In the maintenance state (S5), after excluding the solidified ink from the nozzle 55 by the maintenance mechanism 27, when a predetermined time elapses after the operation of the maintenance mechanism 27 before the sensor 31 detects the reduction of the ink of the second tank 13, the control unit 29 further excludes the solidified ink from the nozzle 55 by the maintenance mechanism 27. Accordingly, the printing error due to the solidified ink is further suppressed.

In a maintenance state (S5) of another example, when a predetermined time elapses after the operation of the first pump 14 before the sensor 31 detects the reduction of the ink of the second tank 13, the control unit 29 further excludes the solidified ink from the nozzle 55 by the maintenance mechanism 27. Accordingly, the printing error due to the solidified ink is further suppressed.

The maintenance mechanism 27 includes the tank 71 that receives the head 21 and accommodates the solvent S that lowers the viscosity of the ink. In the maintenance state (S5), the control unit 29 soaks the nozzle 55 of the head 21 in the solvent S of the tank 71 to remove the solidified ink. Therefore, the head 21 and the nozzle 55 are suppressed from being damaged and then the printing error due to the solidified ink is further suppressed.

The sensor 31 includes the float sensor 32 that floats on the ink accommodated in the second tank 13. The float sensor 32 is used to control the circulation of the ink in the inkjet printer 10. Therefore, it is possible to suppress the increases in the number of components and manufacturing cost of the inkjet printer 10.

The control unit 29 fits the head 21 in the tank 71 in the stand-by state (S1 and S8). Therefore, the ink is suppressed from being exposed to the air in the nozzle 55 of the head 21. By suppressing the exposure of the ink to the air, it is possible to suppress the ink from being solidified due to the evaporation of the moisture or volatile components of the ink.

The control unit 29 fluctuates the meniscus M of the ink of the nozzle 55 of the head 21 in the stand-by state (S1 and S8). Therefore, the ink is suppressed from being solidified in the nozzle 55 of the head 21.

In the stand-by state (S1 and S8), the control unit 29 opens the valve 24 and operates the second pump 26 to transport the ink from the second tank 13 to the third tank 23 through the head 21. When the sensor 31 detects that the ink of the second tank 13 is reduced more than a predetermined amount, the control unit 29 operates the first pump 14 to transport the ink from the first tank 11 to the second tank 13.

In the maintenance state (S5), the control unit 29 stops the second pump 26 and closes the valve 24 before increasing the pressure inside the second tank 13.

The head 21 includes a driving element that pressurizes the ink to discharge the ink from the nozzle 55 and the ink passes through the driving element when the ink is transported from the second tank to the third tank by the second pump.

In the stand-by states (S1 and S8), when the ink is transported from the second tank 13 to the third tank 23 by the second pump 26, the ink passes through the pressure chamber 57 of the driving element 44. By passing the ink through the pressure chamber 57, the ink moves around in the vicinity of the nozzle 55 and thus it is possible to suppress the ink from being solidified in the nozzle 55.

Next, a second embodiment of the inkjet printer 10 will be described with reference to FIG. 12. In the embodiment described below, components having the same functions as those of the inkjet printer 10 of the first embodiment are denoted by the same reference numeral. Further, description of the components may be partially or entirely omitted.

Figure 12:
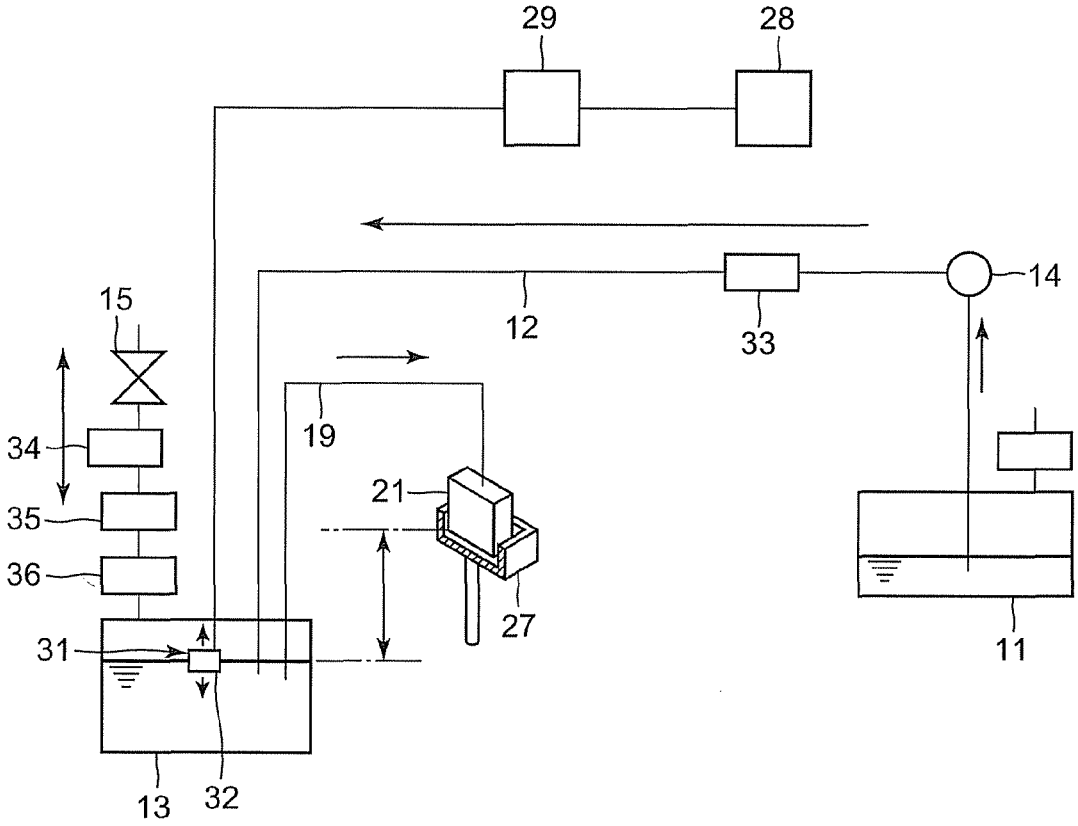
FIG. 12 is a block diagram schematically illustrating an inkjet printer according to a second embodiment.

FIG. 12 is a block diagram schematically illustrating an inkjet printer 10A according to a second embodiment. As illustrated in FIG. 12, the inkjet printer 10A includes a first tank 11, a first path 12, a second tank 13, a first pump 14, an air valve 15, a second path 19, a head 21, a maintenance mechanism 27, an instruction unit 28, and a control unit 29. In the inkjet printer 10A, the ink does not circulate.

Also in the non-circulation inkjet printer 10A, the printing error due to the solidified ink may be suppressed. For example, in the maintenance state (S5), the control unit 29 closes the air valve 15 and operates the first pump 14 to transport the ink from the first tank 11 to the second tank 13 to increase the pressure inside the second tank 13. The ink is discharged from the nozzle 55 of the head 21 by the pressure of the second tank 13 so that the ink of the second tank 13 is reduced. When the sensor 31 detects the reduction of the ink, the control unit 29 opens the air valve 15 so as to be switched in the printing state (S6). When a predetermined time elapses after the operation of the first pump 14 before the sensor 31 detects the reduction of the ink of the second tank 13, the control unit 29 excludes the solidified ink from the nozzle 55 by the maintenance mechanism 27. Accordingly, the printing error due to the solidified ink may be suppressed.

According to the image forming device of at least one of the above-described embodiments, when a predetermined time elapses after the operation of the first pump 14 before the sensor 31 detects the reduction of the ink of the second tank 13, the control unit 29 excludes the solidified ink from the nozzle 55 by the maintenance mechanism 27. Accordingly, the printing error due to the solidified ink may be suppressed.

While the present invention has been described with reference to embodiments, it is to be understood that the invention is not limited to the disclosed embodiments. These new embodiments may be carried out by various types. Various omission, modifications, and changes may be allowed without departing from the gist of the invention. The embodiments or modification thereof may be included in the scope of the invention and also included in the invention described in the claims and equivalents thereof.

For example, the maintenance mechanism 27 is not limited to using the tank 71 in which the solvent S is accommodated. The maintenance mechanism 27, for example, may be a device that wipes the nozzle 55 using a cotton swab in which the solvent S is permeated or a device that wipes the nozzle 55 using a rubber blade or a device that sucks the ink of the nozzle 55 by a jig after soaking the nozzle 55 with the solvent or other device that removes the solidified ink from the nozzle 55 of the head 21.

Further, the sensor 31 is not limited to using the float sensor 32. The sensor 31 may include a pressure sensor that detects the pressure inside the second tank 13 or an optical sensor that detects the level of the ink accommodated in the second tank 13, or other sensor that detects the increase or decrease of the ink accommodated in the second tank 13.

What is claimed is:

1. An image forming device, comprising:
a first tank that accommodates ink;
a first path that is connected to the first tank;
a second tank that is connected to the first tank through the first path and accommodates the ink;
a first pump that is in the first path and transports the ink accommodated in the first tank to the second tank;
an air valve that is opened to release the second tank to the atmosphere and is closed to block the second tank from the atmosphere;
a second path that is connected to the second tank;
a head that is connected to the second tank through the second path, includes a nozzle, and discharges the ink from the nozzle;
a maintenance mechanism that excludes solidified ink present in the nozzle from the nozzle;
a sensor that is disposed in the second tank and detects the increase or decrease of the ink accommodated in the second tank;
an instruction unit that issues a printing instruction; and
a control unit that is switched in a stand-by state, a maintenance state, and a printing state,
wherein in the stand-by state, when the instruction unit issues the printing instruction, the control unit is switched in the maintenance state,
in the maintenance state, the control unit closes the air valve and operates the first pump to transport the ink from the first tank to the second tank to increase a pressure inside the second tank, and when the sensor detects the reduction of the ink of the second tank, the control unit opens the air valve and is switched in the stand-by state, and when a predetermined time elapses after the operation of the first pump before the sensor detects the reduction of the ink of the second tank, the control unit excludes the solidified ink from the nozzle by the maintenance mechanism, and
in the printing state, the control unit is switched in the stand-by state when the ink is discharged from the nozzle of the head based on the printing instruction.

2. The image forming device according to claim 1, wherein in the maintenance state, when a predetermined time elapses after the operation of the maintenance mechanism before the sensor detects the reduction of the ink of the second tank, the control unit further excludes the solidified ink from the nozzle by the maintenance mechanism.

3. An image forming device, comprising:
a first tank that accommodates ink;
a first path that is connected to the first tank;
a second tank that is connected to the first tank through the first path and accommodates the ink;
a first pump that is in the first path and transports the ink accommodated in the first tank to the second tank;
an air valve that is opened to release the second tank to the atmosphere and is closed to block the second tank from the atmosphere;
a second path that is connected to the second tank;
a head that is connected to the second tank through the second path, includes a nozzle, and discharges the ink from the nozzle;
a maintenance mechanism that excludes solidified ink present in the nozzle from the nozzle;
a sensor that is disposed in the second tank and detects the increase or decrease of the ink accommodated in the second tank;
an instruction unit that issues a printing instruction; and
a control unit that is switched in a stand-by state, a maintenance state, and a printing state,
wherein in the stand-by state, when the instruction unit issues the printing instruction, the control unit is switched in the maintenance state,
in the maintenance state, the control unit closes the air valve, excludes the solidified ink from the nozzle by the maintenance mechanism, and operates the first pump to transport the ink from the first tank to the second tank to increase a pressure inside the second tank, and when the sensor detects the reduction of the ink of the second tank, the control unit opens the air valve and is switched in the stand-by state, and
in the printing state, the control unit is switched in the stand-by state when the ink is discharged from the nozzle of the head based on the printing instruction.

4. The image forming device according to claim 3, wherein in the maintenance state, when a predetermined time elapses after the operation of the first pump before the sensor detects the reduction of the ink of the second tank, the control unit further excludes the solidified ink from the nozzle by the maintenance mechanism.

5. The image forming device according to claim 2, wherein the maintenance mechanism includes a tank that receives the head and accommodates a solvent that lowers a viscosity of the ink, and
in the maintenance state, the control unit soaks the nozzle of the head in the solvent of the tank to remove the solidified ink.

6. The image forming device according to claim 5, wherein the sensor has a float sensor that floats on the ink accommodated in the second tank.

7. The image forming device according to claim 6, wherein in the stand-by state, the control unit fits the head in the tank.

8. The image forming device according to claim 7, wherein in the stand-by state, the control unit fluctuates a surface of the ink of the nozzle of the head.

9. The image forming device according to claim 8, further comprising:
a third path that is connected to the head;

a third tank that is connected to the head through the third path and accommodates the ink;

a valve which is in the third path and closed to block the third path;

a fourth path that connects the third tank and the first tank; and a second pump that is in the fourth path and transports the ink, wherein in the stand-by state, the control unit opens the valve to operate the second pump to transport the ink from the second tank to the third tank through the head, and when the sensor detects that the ink of the second tank is reduced more than a predetermined amount, operates the first pump to transport the ink from the first tank to the second tank, in the maintenance state, the control unit stops the second pump before increasing the pressure inside the second tank and closes the valve, and the head includes a driving element that pressurizes the ink to discharge the ink from the nozzle and the ink passes through the driving element when the ink is transported from the second tank to the third tank by the second pump.

10. An image forming method of an image forming device that includes:

a first tank that accommodates ink;

a first path that is connected to the first tank;

a second tank that is connected to the first tank through the first path and accommodates the ink;

a first pump that is in the first path and transports the ink accommodated in the first tank to the second tank;

an air valve that is opened to release the second tank to the atmosphere and is closed to block the second tank from the atmosphere;

a second path that is connected to the second tank;

a head that is connected to the second tank through the second path, includes a nozzle, and discharges the ink from the nozzle;

a maintenance mechanism that excludes solidified ink present in the nozzle from the nozzle;

a sensor that is in the second tank and detects the increase or decrease of the ink accommodated in the second tank; and an instruction unit that issues a printing instruction, the method comprising:

closing the air valve when the instruction unit issues the printing instruction;

operating the first pump to transport the ink from the first tank to the second tank to increase a pressure inside the second tank, opening the air valve when the sensor detects that the ink of the second tank is reduced;

excluding the solidified ink from the nozzle by the maintenance mechanism when a predetermined time elapses after the operation of the first pump before the sensor detects the reduction of the ink of the second tank; and discharging the ink from the nozzle of the head based on the printing instruction.

11. The image forming method according to claim 10, further comprising:

after excluding the solidified ink from the nozzle by the maintenance mechanism, when a predetermined time elapses after the operation of the maintenance mechanism before the sensor detects the reduction of the ink of the second tank, further excluding the solidified ink from the nozzle by the maintenance mechanism.

12. The image forming method according to claim 11, wherein the maintenance mechanism includes a tank that receives the head and accommodates a solvent that lowers a viscosity of the ink, and by soaking the nozzle of the head in the solvent of the tank, the solidified ink is removed.

13. The image forming method according to claim 12, wherein the sensor has a float sensor that floats on the ink accommodated in the second tank.

14. The image forming method according to claim 13, wherein before the instruction unit issues the printing instruction, the head is fitted in the tank.

15. The image forming method according to claim 14, wherein before the instruction unit issues the printing instruction, a surface of the ink of the nozzle of the head is fluctuated.

16. The image forming method according to claim 15, wherein the device further includes:

a third path that is connected to the head;

a third tank that is connected to the head through the third path and accommodates the ink;

a valve which is in the third path and closed to block the third path;

a fourth path that connects the third tank and the first tank; and a second pump that is in the fourth path and transports the ink, and the head includes a driving element that pressurizes the ink to discharge the ink from the nozzle, the ink passes through the driving element when the ink is transported from the second tank to the third tank by the second pump, before the instruction unit issues the printing instruction, the valve is opened to operate the second pump so that the ink is transported from the second tank to the third tank through the head, when the sensor detects that the ink of the second tank is reduced more than a predetermined amount, the first pump is operated to transport the ink from the first tank to the second tank, and after the instruction unit issues the printing instruction, before increasing the pressure inside the second tank, the second pump is stopped and the valve is closed.

* * * * *